US008629352B2

(12) United States Patent
Ando et al.

(10) Patent No.: US 8,629,352 B2
(45) Date of Patent: Jan. 14, 2014

(54) ENAMELED INSULATED WIRE AND MANUFACTURING METHOD THEREOF

(75) Inventors: Yoshiyuki Ando, Hitachi (JP); Tomiya Abe, Hitachi (JP); Shigehisa Motowaki, Hitachi (JP); Ryoichi Kajiwara, Mito (JP)

(73) Assignees: Hitachi Cable, Ltd., Tokyo (JP); Hitachi, Ltd., Tokyo (JP)

( * ) Notice: Subject to any disclaimer, the term of this patent is extended or adjusted under 35 U.S.C. 154(b) by 475 days.

(21) Appl. No.: 12/843,964

(22) Filed: Jul. 27, 2010

(65) Prior Publication Data

US 2011/0024156 A1 Feb. 3, 2011

(30) Foreign Application Priority Data

Jul. 29, 2009 (JP) ..... 2009-175944

(51) Int. Cl.
*H01B 3/18* (2006.01)

(52) U.S. Cl.
USPC ..... 174/110 A

(58) Field of Classification Search
USPC ..... 174/110, 68.1, 110 S, 110 R, 110 A
See application file for complete search history.

(56) References Cited

U.S. PATENT DOCUMENTS

| | | | | |
|---|---|---|---|---|
| 5,917,155 | A * | 6/1999 | Hake et al. | 174/120 R |
| 6,087,592 | A * | 7/2000 | Nagel et al. | 174/120 R |
| 6,180,888 | B1 * | 1/2001 | Yin et al. | 174/110 R |
| 6,329,055 | B1 * | 12/2001 | Higashiura et al. | 428/383 |
| 6,403,890 | B1 * | 6/2002 | McGregor et al. | 174/120 R |
| 6,811,875 | B2 * | 11/2004 | Kikuchi et al. | 428/372 |
| 7,411,127 | B2 * | 8/2008 | Viguerie | 174/74 R |
| 7,794,847 | B2 * | 9/2010 | Chasey et al. | 428/500 |
| 8,193,451 | B2 * | 6/2012 | Kikuchi et al. | 174/110 R |
| 2005/0118422 | A1 * | 6/2005 | Cipelli et al. | 428/375 |
| 2006/0278254 | A1 | 12/2006 | Jackson | |
| 2007/0145606 | A1 | 6/2007 | Mahler | |
| 2007/0181334 | A1 * | 8/2007 | Lee et al. | 174/110 R |
| 2009/0197375 | A1 | 8/2009 | Kajiwara et al. | |
| 2010/0108356 | A1 * | 5/2010 | Abe et al. | 174/120 SC |

FOREIGN PATENT DOCUMENTS

| | | |
|---|---|---|
| JP | 58-202556 | 11/1983 |
| JP | 10-334735 | 12/1998 |
| JP | 2001-093340 | 4/2001 |
| JP | 2009-182159 | 8/2009 |
| WO | WO 2008/125559 A1 | 10/2008 |

OTHER PUBLICATIONS

Korean office action of Appln. No. 10-2010-18861 dated Mar. 28, 2012 with partial English translation.

* cited by examiner

*Primary Examiner* — Chau Nguyen
(74) *Attorney, Agent, or Firm* — Antonelli, Terry, Stout & Kraus, LLP.

(57) ABSTRACT

There is provided an enameled insulated wire, which includes: a metal conductor; an intermediate layer around the metal conductor, the intermediate layer containing metal oxide particles, the metal oxide particles including at least one oxide selected from a group consisting of zinc oxides, tin oxides, compound oxides of zinc and the metal constituent of the metal conductor, and compound oxides of tin and the metal constituent of the metal conductor, diameter of the metal oxide particles being predominantly from 1 to 50 nm; and an insulation coating around the intermediate layer.

10 Claims, 5 Drawing Sheets

ENAMELED INSULATED WIRE AND MANUFACTURING METHOD THEREOF

CLAIM OF PRIORITY

The present application claims priority from Japanese patent application serial no. 2009-175944 filed on Jul. 29, 2009, the content of which is hereby incorporated by reference into this application.

BACKGROUND OF THE INVENTION

1. Field of the Invention

The present invention relates to enameled insulated wires formed by applying an insulation varnish around a metal conductor followed by baking, and particularly to enameled insulated wires and, in which adhesion between the metal conductor and the insulation coating does not significantly degrade even at relatively high temperatures. Furthermore, the present invention relates to manufacturing methods of the enameled insulated wire.

2. Description of Related Art

Enameled insulated wires are widely used for coil wires in electrical equipment such as rotary electric machines and transformers. Such enameled insulated wires include: a metal conductor, which is formed so as to have a desired cross section (such as circular and rectangular) depending on a shape and application of the coil; and a single layer or multilayer insulation coating around the metal conductor. Typically, enameled insulated wires (sometimes simply referred to as "insulated wires" and "enameled wires") are formed by applying, around a metal conductor, an insulation coating varnish (also referred to as "insulation varnish") followed by baking. Such insulation varnishes are typically prepared by dissolving a resin (such as polyimide, polyamideimide, and polyesterimide) in an organic solvent.

In recent years, in order to reduce the manufacturing cost of such electrical equipment as described above, there has been a trend toward automated, high throughput manufacture. In keeping with this trend, progress is also being made toward the automation of coil winding processes. And, because of the downsizing of such electrical equipment, enameled insulated wires are wound around a smaller diameter core of the coil with a finer pitch under higher tension. During such processes, enameled insulated coil wires are subjected to stronger bending force or higher friction, and therefore have a higher possibility of being damaged. Such damage to the enameled insulated coil wire may cause failures such as interlayer short circuits and ground faults, thus degrading the yield of the coil. Hence, there is a strong demand for enameled insulated wires with better processability.

To improve the processability of enameled insulated wires, various efforts are being made, such as increasing their resistance to mechanical stresses and providing their surface with lubricity. However, such efforts have yet to sufficiently meet recent harsh demands of coil winding processes. So, in another effort, attempts are being made to increase adhesion between metal conductors and insulation coatings. Such an increase in adhesion can prevent the insulation coating of an enameled insulated wire from peeling from the metal conductor even when the wire receives larger external stresses. Thus, better processability is obtained.

A typical method for achieving stronger adhesion between a metal conductor and an insulation coating is to improve the insulation varnish used to form the insulation coating. For example, JP-A Hei 10 (1998)-334735 discloses an insulated wire formed by applying a polyimide-based insulation varnish around a copper conductor followed by baking, in which the polyimide-based insulation varnish used is prepared by adding 0.1 to 20 parts by weight of melamine to 100 parts by weight of a polyimide-based resin. According to this JP-A Hei 10 (1998)-334735, the resulting polyimide-based insulation coating has excellent properties such as high mechanical strength, high thermal resistance and high chemical resistance and also achieves very strong adhesion to the copper conductor. Such a good result is obtained probably because incorporation of terminal groups with high polarity such as a hydroxy group and an amino group in the insulation coating enhances interaction between the copper conductor and the insulation coating.

Another method for achieving stronger adhesion between a metal conductor and an insulating coating is to surface-treat the metal conductor to form an intermediate layer and to improve the adhesion by the aid of this intermediate layer. For example, JP-A 2001-93340 discloses an insulated wire formed by precoating a core wire with an alkoxysilane compound and then by coating a thermoplastic polyester-based resin or a resin composition containing it around thus precoated core wire. This method is effective probably because mercapto groups in a mercapto-alkoxysilane or amino groups in an amino-alkoxysilane form a strong chemical bond with a copper conductor, and also condensation of silanol groups in these compounds causes the precoating (intermediate) layer to strong adhere to both the core wire and the resin coating.

On the other hand, recently, there has been a growing demand for high output power and/or low energy consumption as well as small-size in the electric apparatus field. To meet this demand, a rapid trend exists toward use of inverters to control rotary electric machines. Also, in such applications, higher voltage and higher current (i.e., higher electric power) inverters are increasingly used. As a result, coils are increasingly used at higher operating temperatures.

Conventional methods for achieving high quality resins have a problem in that even if a particular property of interest of a resin is improved, other important properties thereof may be sacrificed. In addition, even if all important properties of a resin are improved, a cost problem arises because such a novel resin may require non-conventional special manufacturing processes which conventional mass production lines do not include. Such above-mentioned intermediate layers can also be formed by using silane coupling agent treatment. However, the intermediate layers formed by silane coupling agent treatment are prone to suffer from thermal degradation at high temperatures (e.g., above 150° C.) particularly when kept for a long time (e.g., one hour), thus potentially degrading adhesion between the metal conductor and the insulation coating. That is, intermediate layers formed by silane coupling agent treatment have a problem of poor thermal reliability (poor long term thermal resistance).

SUMMARY OF THE INVENTION

In view of the foregoing, it is an objective of the present invention to provide an enameled insulated wire, in which the adhesion between the metal conductor and the insulation coating is strong and does not significantly degrade even at relatively high temperatures. Furthermore, it is another objective of the invention to provide a manufacturing method of the enameled insulated wire.

(1) According to one aspect of the present invention, there is provided a manufacturing method for an enameled insulated wire, which includes the steps of:

(a) applying, around a metal conductor, a processing solution including an organic metal compound, the organic metal compound including an organic carboxylic acid-metal complex and/or a β-diketone metal complex, the organic metal compound including, as a metal constituent, zinc (Zn) and/or tin (Sn);

(b) baking the applied processing solution in order to form an intermediate layer that adheres around the metal conductor, the intermediate layer including an oxide of the metal constituent of the organic metal compound;

(c) applying, around the intermediate layer, an insulation varnish including a resin composition, the resin composition including, as a major constituent, a material selected from a group consisting of polyesterimide, polyamideimide, polyimide, polyester and polyurethane; and (d) baking the applied insulation varnish to form an insulation coating.

In the above aspect (1) of the invention, the following modifications and changes can be made.

(i) The step (b) is conducted at a temperature from 300 to 500° C. in a non-oxidizing atmosphere.

(ii) The step (b) is conducted at a temperature from 150 to 200° C. in an oxidizing atmosphere under irradiation of ultraviolet light.

(iii) The concentration of the metal constituent in the processing solution is from 0.001 to 1.0 mass %.

(2) According to another aspect of the present invention, there is provided an enameled insulated wire, which includes:

a metal conductor;

an intermediate layer around the metal conductor, the intermediate layer containing metal oxide particles, the metal oxide particles including at least one oxide selected from a group consisting of zinc oxides, tin oxides, compound oxides of zinc and the metal constituent of the metal conductor, and compound oxides of tin and the metal constituent of the metal conductor, diameter of the metal oxide particles being predominantly from 1 to 50 nm; and an insulation coating around the intermediate layer.

In the above aspect (2) of the invention, the following modifications and changes can be made.

(iv) The intermediate layer is an organic amorphous matrix having dispersed therein the metal oxide particles.

(v) Average thickness of the intermediate layer is from 20 to 2000 nm.

(vi) The insulation coating is made of a resin composition including, as a major constituent, a material selected from a group consisting of polyesterimide, polyamideimide, polyimide, polyester and polyurethane.

(vii) The metal conductor is made of a metal selected from a group consisting of copper (Cu), copper alloys, aluminum (Al) and aluminum alloys.

Advantages of the Invention

According to the present invention, it is possible to provide an enameled insulated wire, in which the adhesion between the metal conductor and the insulation coating is strong and does not significantly degrade even at relatively high temperatures. Furthermore, it is possible to provide a manufacturing method for the enameled insulated wire of the invention, in which starting materials are inexpensive and the productivity is excellent. Thus, a high quality enameled insulated wire can be manufactured at low cost.

DETAILED DESCRIPTION OF THE PREFERRED EMBODIMENTS

Preferred embodiments of the present invention will be described below with reference to the accompanying drawings. However, the invention is not limited to the specific embodiments described below.

(Structure of Enameled Insulated Wire)

Figure 1:
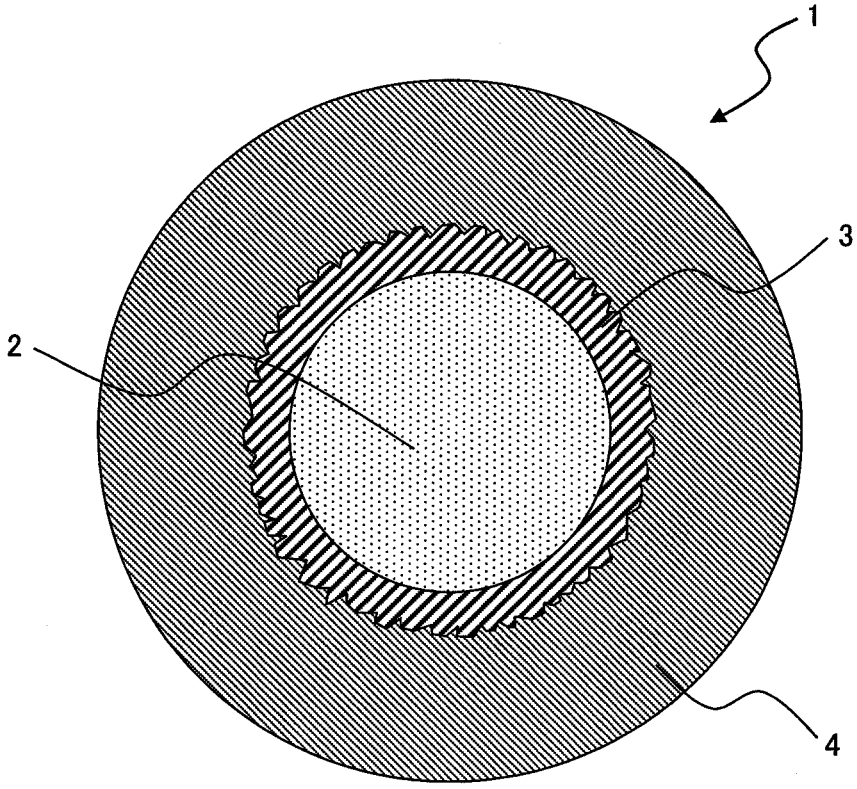
FIG. 1 is a schematic illustration showing a cross-sectional view of an example of an enameled insulated wire of the present invention.

FIG. 1 is a schematic illustration showing a cross-sectional view of an example of an enameled insulated wire of the present invention. As illustrated in FIG. 1, an enameled insulated wire 1 of the invention comprises: a metal conductor 2; an intermediate layer 3 containing metal oxide particles formed around the metal conductor 2; and an insulation coating 4 surrounding the intermediate layer 3. The metal oxide particles are made of an oxide of zinc (Zn) or tin (Sn), and/or a compound metal oxide of Zn (and/or Sn) and the metal constituent contained in the metal conductor 2. And, the diameter of the metal oxide particles is predominantly from 1 to 50 nm. Herein, an inconsiderable amount of the metal oxide particles having a diameter outside of the scope of 1 to 50 nm may be included.

A preferable metal constituent for the metal conductor 2 is copper (Cu), a copper alloy, aluminum (Al) or an aluminum alloy. The Zn (and/or Sn) contained in the intermediate layer 3 more strongly bonds with oxygen (O) than Cu, and therefore is suitable for forming, on Cu, an oxide of Zn (and/or Sn) or a compound oxide of Zn (and/or Sn) and Cu. By contrast, the Al is more readily oxidized than Zn and Sn. However, Al forms an inert oxide layer on its surface, which prevents further oxidation. Therefore, an oxide of Zn (and/or Sn) can be successfully formed also on Al. Herein, the Zn/O (or Sn/O) ratio needs not necessarily be strictly stoichiometric (1:1 for ZnO and SnO), but may be, e.g., slightly larger than 1:1.

The intermediate layer 3 may be either an aggregation of the metal oxide particles or an organic amorphous matrix having dispersed therein the metal oxide particles. Enameled insulated wires 1 using the latter intermediate layer 3 have an advantage of higher resistance to bending stresses because the organic amorphous matrix absorbs such bending stresses exerted on the wire.

The average thickness of the intermediate layer 3 is preferably from 20 to 2000 nm, and more preferably from 20 to 500 nm. Thicknesses less than 20 nm will not sufficiently provide the effect of improving adhesion between the metal conductor 2 and the insulation coating 4. On the other hand, thicknesses more than 2000 nm will increase the internal stress of the intermediate layer 3 and may cause the intermediate layer 3 to peel from the metal conductor 2.

Materials for the insulation coating 4 particularly preferably have a polar functional group. For example, resin compositions containing, as a major constituent, polyesterimide, polyimide, polyester, polyamideimide, polyurethane or the like are preferable. This is because the polar functional group contained in these resin compositions chemically interacts with the metal oxide particles contained in the intermediate layer 3, and therefore has the effect of improving adhesion between the intermediate layer 3 and the insulation coating 4. In addition, the insulation coating 4 may be either a single layer or a multilayer (e.g., two-layer and three-layer).

(Method for Manufacture of Enameled Insulated Wire)

Figure 2:
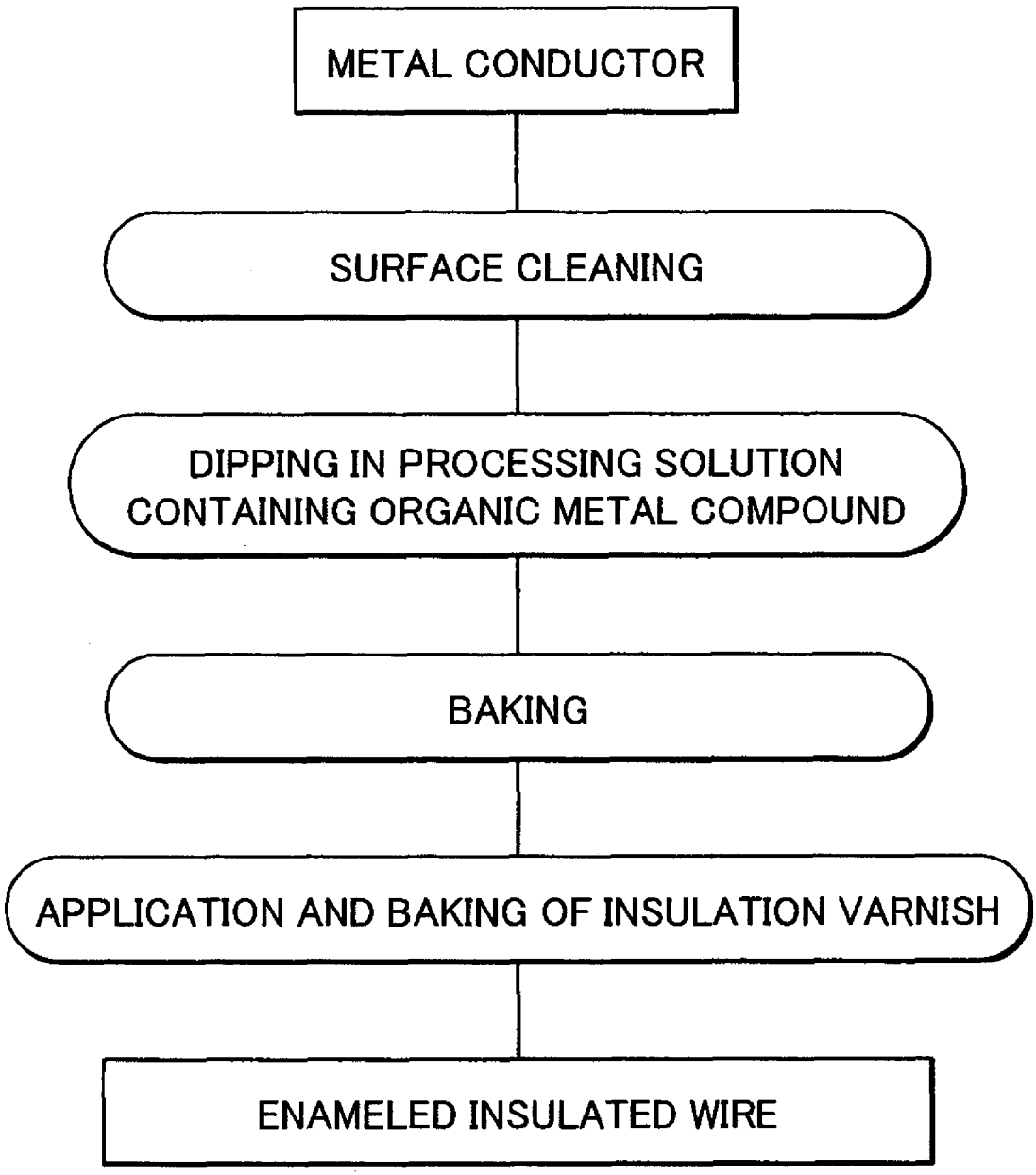
FIG. 2 is an exemplary flow chart for manufacturing an enameled insulated wire according to the present invention.

FIG. 2 is an exemplary flow chart for manufacturing an enameled insulated wire according to the present invention. First, contaminants such as organic materials and the like that adsorb onto a surface of the metal conductor 2 are removed for a surface cleaning purpose. There is no particular limitation on a surface cleaning method, but it is preferred to remove such organic materials by cathode electrolytic degreasing, UV (ultraviolet) irradiation or the like in view of manufacturing automation or manufacturing speed (for example, when used in an in-line surface cleaning step).

Next, a processing solution containing a Zn- and/or Sn-containing organic metal compound is coated around the metal conductor 2 by dipping the metal conductor 2 in the processing solution. The processing solution is a mixture of the Zn- and/or Sn-containing organic metal compound and a solvent. The Zn- and/or Sn-containing organic metal compound preferably contains only carbon (C), hydrogen (H), oxygen (O), and Zn (and/or Sn) in order to enhance pyrolysis thereof and to prevent a formation of undesirable pyrolysates. Specifically, for example, organic carboxylic acid-metal complexes (such as metal 2-ethylhexanoates and metal neodecanoates) and β-diketone metal complexes (such as acetylacetone metal complexes) are preferable. These compounds can be made from cheap raw materials and have carboxyl or carbonyl group which is readily pyrolyzed, and are therefore advantageous in that the intermediate layer 3 can be easily formed in the succeeding process step.

The solvent for the processing solution is preferably an organic (nonaqueous) solvent such as alcohol, acetone and toluene. The use of such a nonaqueous processing solution can suppress corrosion or oxidation of the metal conductor 2. When dissolving the organic metal compound in the solvent, there is no particular limitation on the metal constituent concentration in the processing solution. However, the metal constituent concentration is preferably from 0.001 to 5.0 mass % and more preferably from 0.001 to 1.0 mass % in view of the controllability of the dip-coating process.

Then, the coated processing solution is baked by heating, thereby forming the intermediate layer 3 that adheres around the metal conductor 2. By this baking, the organic constituents in the solution are pyrolyzed, oxidized and vaporized away, and the remaining metallic constituents form metal oxide particles (having a diameter of from about 1 to 50 nm). Metal complexes such as metal 2-ethylhexanoates and metal neodecanoates can be pyrolyzed at temperatures higher than about 300° C. Herein, baking in an oxidizing atmosphere causes the following problem: When a metal conductor based on copper (such as pure copper and a copper alloy) is heated above 200° C. (e.g., 250° C.) in an oxidizing atmosphere (such as air), a thick copper oxide film is formed around its surface. Such a thick copper oxide film may be mechanically very weak and may as a result peel off from the metal conductor when subjected to mechanical stresses, thus potentially degrading adhesion between the metal conductor and an insulation coating. In order to address this problem with the decomposition of the organic metal compounds, the inventors have investigated combined utilization of thermal and optical energies rather than single utilization of thermal energy. And, the inventors have found that the organic metal compounds can be decomposed at temperatures as low as 150 to 200° C. by utilizing UV light (e.g., by using a low pressure mercury lamp), and that the thickness of the resulting undesirable copper oxide film can be suppressed to as thin as less than approximately 100 nm. The inventors have further revealed that UV lasers (such as rare gas halide excimer lasers) are also effectively used for low temperature decomposition of the organic metal compounds.

In contrast, in non-oxidizing atmospheres (such as nitrogen), the above baking process can be performed at temperatures from 300 to 500° C. In this baking process, part of the organic constituents in the processing solution can be caused to remain unremoved in an amorphous form. Thus, the intermediate layer 3 can be formed to have a structure in which metal oxide particles are dispersed in an organic amorphous matrix. In addition, if this baking condition is also enough to anneal the metal conductor, this baking step for forming the intermediate layer 3 can also serve as an annealing step of the metal conductor 2 (that is, no further annealing step is needed). This leads to manufacturing step reduction as well as cost reduction. The above-described two types of baking processes in oxidizing and non-oxidizing atmospheres both provide the intermediate layer 3 (formed around the metal conductor 2) with a desirable surface microroughness due to the metal oxide particles.

After the formation of the intermediate layer 3, an insulation varnish is applied around the intermediate layer 3 followed by baking. Thus, the fabrication of the enameled insulated wire 1 is completed. There is no particular limitation on the method for applying and baking the insulation varnish; any conventional method can be used. The insulation varnish is preferably made with a resin composition containing, as a major constituent, polyesterimide, polyamideimide, polyimide, polyester, or polyurethane. As already described, these resin compositions contain a polar functional group which chemically interacts with the metal oxide particles contained in the intermediate layer 3, and therefore have the effect of improving adhesion between the intermediate layer 3 and the insulation coating 4.

(Discussion on Effect and Formation Mechanism of Intermediate Layer)

Generally, a smooth surface of metal (in particular, good-conducting metal such as copper, silver and gold) has poor adhesion to polymer resins. Conventionally, to improve adhesion between a metal and polymer resins, an intermediate layer is formed on the surface of the metal by using, for example, a silane coupling agent treatment. However, such conventional intermediate layers formed by the silane coupling agent treatment or the like chemically bond with a polymer resin via an organic functional group. Such organic functional groups may undergo transformation or decomposition by heating at high temperature (e.g., above 150° C.) for a few hours (e.g., 1 hour or longer), and as a result the adhesion may decrease.

By contrast, the intermediate layer 3 according to the present invention comprises mainly metal oxide particles, and therefore does not undergo transformation or decomposition even when heated to high temperature (e.g., above 150° C.) for a few hours (e.g., 1 hour or longer). As a result, the adhesion between the metal conductor 2 and the insulation coating 4 does not degrade even when the intermediate layer 3 is exposed to such high temperature for such long time; that is, the invented intermediate layer 3 has an inherent advantage of high thermal reliability (long term thermal resistance). In addition, the intermediate layer 3 has a surface microroughness due to the metal oxide particles, and such a surface microroughness increases the effective contact area between the intermediate layer 3 and the insulation coating 4. As a result, the adhesion between the intermediate layer 3 and the insulation coating 4 is increased by the so-called "anchor effect". The adhesion between the intermediate layer 3 and the insulation coating 4 is further increased by the chemical interaction between the polar functional group contained in the insulation coating 4 and the metal oxide particles.

Vapor phase processes, such as sputtering and chemical vapor deposition (CVD), can also be used to form an intermediate layer containing metal oxide particles. However, these methods are vacuum processes, and therefore have problems of poor productivity and high equipment and material cost. The intermediate layer containing metal oxide particles can also be formed by liquid phase processes. However, processes using an electrolyte solution, such as anodic oxidation, have a problem in that the metal conductor used may be corroded. Sol-gel processes using a metal alkoxide precursor in principle require a large amount of time for polycondensation of the precursor, and are therefore not suitable for manufactures of enameled insulated wires in which a strong need exists for high manufacturing process throughput.

In contrast, the manufacturing method for an enameled insulated wire according to the present invention only involves applying a processing solution containing an organic metal compound around a metal conductor and baking the processing solution. Therefore, the invented method is suitable for high throughput or automated manufacturing. In addition, the invented method requires only a small amount of an organic metal compound, and therefore the material cost is low.

A possible formation mechanism of the intermediate layer of the invention is now described. A generally accepted belief is as follows: When an organic metal compound applied on a metal conductor is heated in an oxidizing atmosphere, no sooner has the compound been decomposed than the resulting metal is oxidized to form metal oxide fine particles. Then, the resulting metal oxide fine particles just cumulate on the surface of the metal conductor. In this case, even when the metal oxide fine particles contact the underlying metal conductor, they do not bond strongly with the conductor; therefore no strong adhesion can be provided.

Contrary to the above general belief, however, it has been found that the intermediate layer formed according to the invention bonds strongly with the underlying metal conductor. Probably, this can be in part explained by the low metal concentration of the processing solution used and the very thin thickness of the coating of the processing solution. A more specific possible explanation is as follows: In the invented processing solution (containing an organic metal compound) applied around a metal conductor, a large amount of organic constituents are present around each metal atom. When the processing solution is baked, the organic constituents are pyrolyzed and a large amount of reducing ions (such as H—, CO—and CH— ions) are produced. Such reducing ions allow the metallic constituents of the organic metal compound to behave temporally like active metal atoms. Such active metal atoms form a strong metallic bond with the surface of the metal conductor (for example, by partially forming a metal alloy), and form an aggregation of metal particles that strongly adhere to the metal conductor. After that, as the amount of the reducing ions decreases, the metal particles are oxidized to form an aggregation of metal oxide particles.

The interface region between the metal conductor and the intermediate layer of an enameled insulated wire of the present invention was examined in detail using, e.g., electron microscopy. The result showed that a region looking like a reaction layer was observed. Intermediate layers having such a reaction layer are difficult to form by other conventional methods such as plating and vapor deposition. Thus, the above structure having a reaction layer can be said to be peculiar to the invented intermediate layer formed by baking an organic metal compound.

EXAMPLES

The present invention will be described by way of examples, which are meant to be merely illustrative and therefore non-limiting.

(Method for Testing and Evaluating Adhesion)

Various enameled insulated wires (Examples 1 to 9 and Comparative examples 1 to 8), which were produced in accordance with the later-described procedure, were tested for the adhesion as follows: The both ends of each enameled insulated wire were clamped by two clamps which were 250 mm apart. And, the insulation coating of each wire was partially stripped off in such a manner that two long strips of the insulation coating were removed along its entire length. Then, one of the clamps was rotated with the other not being rotated at room temperature. And, the initial adhesion of the wire was defined as the number of rotations until the unremoved part of the insulation coating started to bulge out (i.e., partially peel off) from the metal conductor. Also, the adhesion after a test-heating (i.e., the long term thermal resistance) of each wire was tested as follows: Each enameled insulated wire was heat treated in a thermostat bath at 160° C. for 6 hours, and then was tested for the adhesion in the same manner as used in the above initial-adhesion test.

Preparation of Example 1

A 1.0-mm diameter copper wire was used as a metal conductor. First, the copper wire was surface-cleaned by cathode electrolytic degreasing. The electrolytic cleaning solution used was a 10 mass % sodium hydroxide aqueous solution. The electrolytic degreasing condition was as follows: The current density was 5 A/dm$^2$, the cleaning duration was about 2 seconds and the cleaning temperature was 40 to 50° C. Then, the thus surface-cleaned copper wire was washed with pure water and dried.

Next, a processing solution containing an organic metal compound was coated around the copper wire by dipping the copper wire in the processing solution. Then, the thus coated processing solution was dried and baked to form an intermediate layer. The processing solution used was zinc 2-ethylhexanoate dissolved in a 1:1 mixed solvent of acetone and toluene (the Zn concentration was 0.5 mass %). The baking was performed by heating at 500° C. in nitrogen atmosphere for 1 minute. This baking condition was enough also to anneal the metal conductor. Therefore, in Example this baking step also served to anneal the copper wire (i.e., both the baking process for forming the intermediate layer and the annealing process of the copper wire were performed simultaneously by one heat treatment step).

Figure 3:
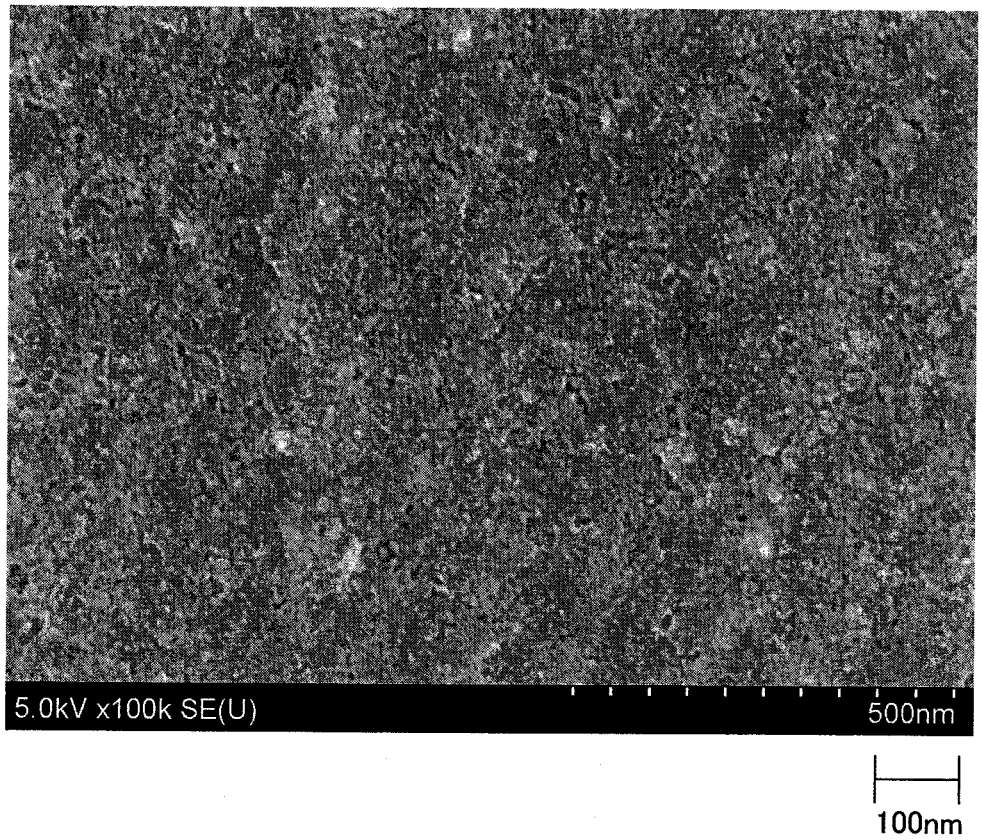
FIG. 3 is a scanning electron microscopy (SEM) image of a surface of an intermediate layer of Example 1.
Figure 4:
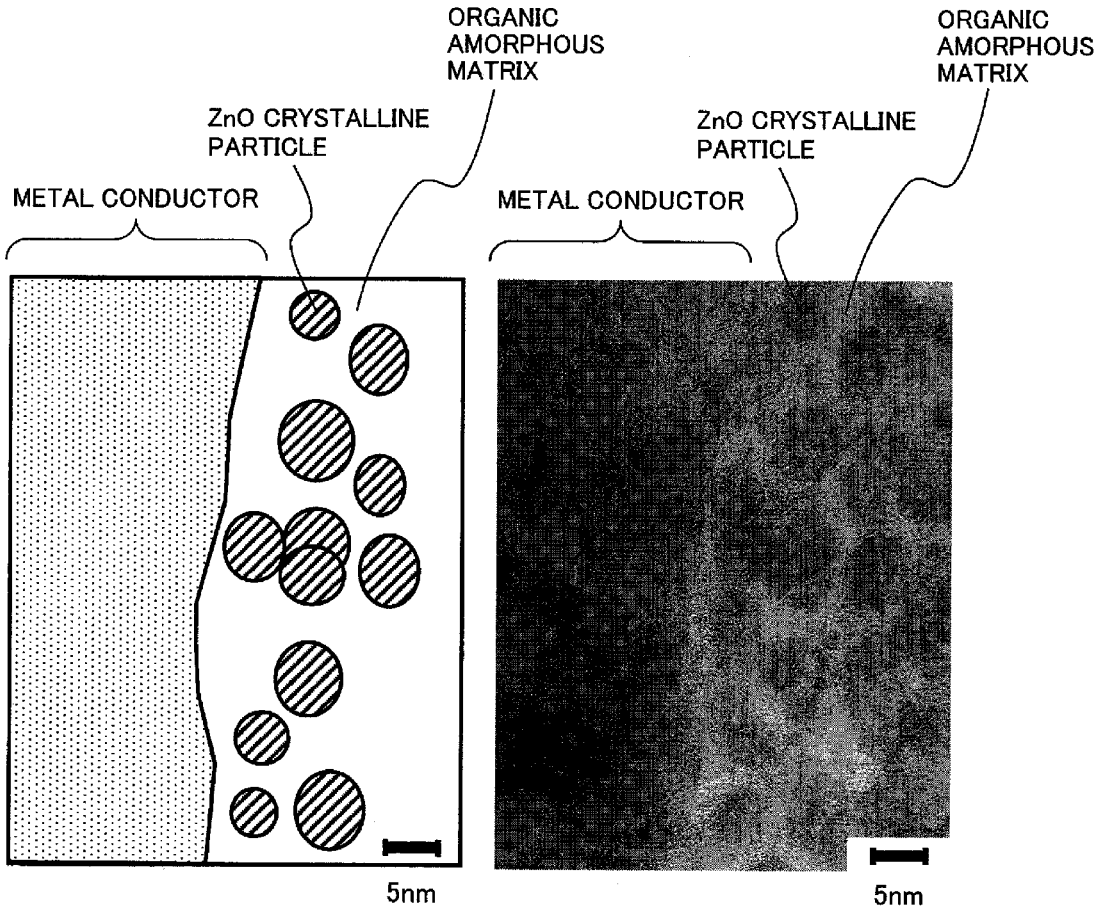
FIG. 4 is a transmission electron microscopy (TEM) image of an interface region between a metal conductor and the intermediate layer of Example 1; and a schematic diagram of the TEM image.

FIG. 3 is a scanning electron microscopy (SEM) image of a surface of the intermediate layer of Example 1. As shown in FIG. 3, the intermediate layer of Example 1 has a surface microroughness of several nanometers. Probably, this surface microroughness provides an anchor effect. FIG. 4 is a transmission electron microscopy (TEM) image of an interface region between the metal conductor and the intermediate layer of Example 1; and a schematic diagram of the TEM image. In this schematic diagram of the TEM image, such particle images which overlap and therefore whose shapes are unclear are not drawn for simplification. As shown in FIG. 4, an amorphous matrix produced by pyrolysis of the organic metal compound (zinc 2-ethylhexanoate in Example 1)

adhered to the metal conductor (copper wire), and metal oxide particles (ZnO particles in Example 1) were dispersed in the amorphous matrix. These particles were further examined under a higher magnification. A lattice pattern of equally spaced lines was observed in each particle image, indicating that the ZnO particles were crystalline. It was considered that these crystalline particles of a diameter of about 5 nm were a cause of the surface microroughness as shown in FIG. 3.

Finally, an insulation varnish made of a polyesterimide-based resin composition was applied around the intermediate layer followed by baking. Thus, the fabrication of the Example 1 enameled insulated wire coated with a 30-μm thick insulation coating was completed. This final process step was performed by a conventional method.

Preparation of Example 2

A 1.0-mm diameter copper wire was used as a metal conductor. First, the copper wire was surface cleaned and annealed simultaneously as follows: The copper wire was irradiated with UV light using a low pressure mercury lamp (center wavelength of 254 nm, lamp intensity of 35 mW/cm, and distance between lamp and sample of 10 cm) for 10 minutes. And then, the copper wire was heated at 500° C. in nitrogen atmosphere for 1 minute while being irradiated with the same UV light. Next, a processing solution containing an organic metal compound was coated around the copper wire by dipping the copper wire in the processing solution. Then, the thus coated processing solution was dried and baked to form an intermediate layer. The processing solution used was zinc 2-ethylhexanoate dissolved in a 1:1 mixed solvent of acetone and toluene (the Zn concentration was 0.5 mass %). The baking was performed by heating at 200° C. in air atmosphere for 30 minutes under irradiation of UV light. The UV light irradiation was performed using a low pressure mercury lamp (center wavelength of 254 nm, lamp intensity of 40 mW/cm, and distance between lamp and sample of 10 cm) mounted in the heat treatment furnace used.

Figure 5:
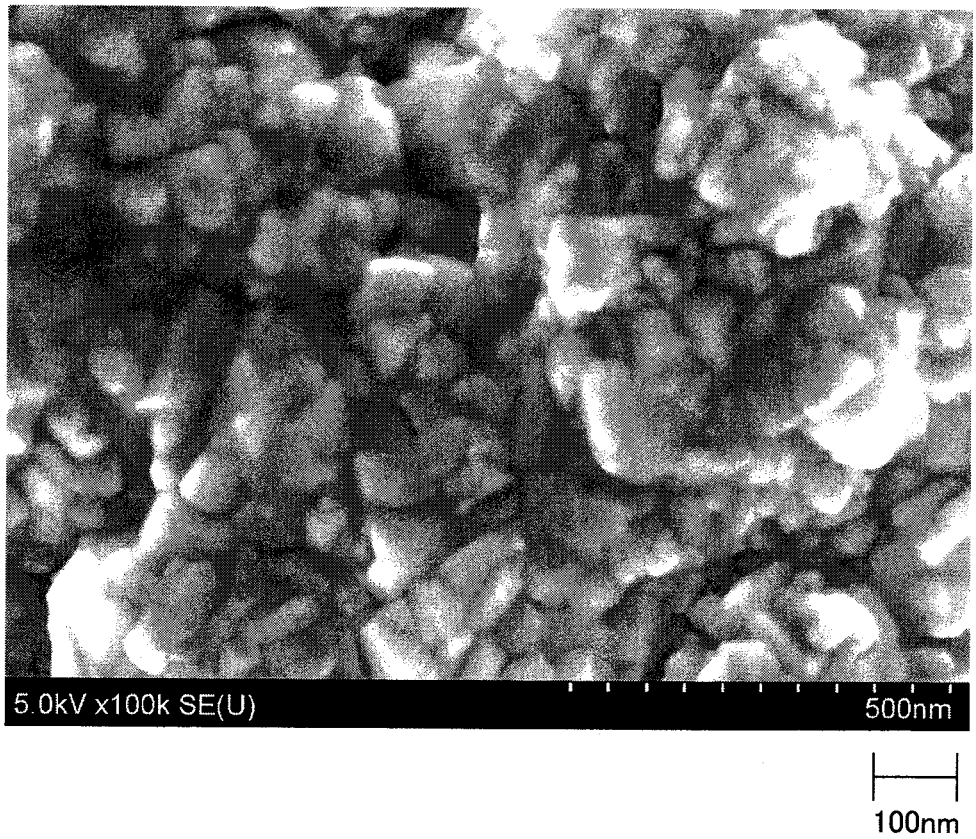
FIG. 5 is a scanning electron microscopy (SEM) image of the surface of the intermediate layer of Example 2.

FIG. 5 is a scanning electron microscopy (SEM) image of the surface of the intermediate layer of Example 2. As shown in FIG. 5, the intermediate layer of Example 2 contains a comparatively small amount of organic residues, and ZnO particles of a relatively large diameter of from 20 to 30 nm were observed across the entire surface. It was considered that because in Example 2, the baking of the processing solution containing an organic metal compound was performed in air atmosphere under irradiation of UV light, and therefore the decomposition of the organic metal compound proceeded more rapidly than would have proceeded if the UV irradiation had not been used. Also, a surface microroughness of from several tens of nanometers to several hundreds of nanometers was observed on the surface of the intermediate layer. Probably, this surface microroughness provided an anchor effect.

Finally, an insulation varnish made of a polyesterimide-based resin composition was applied around the intermediate layer followed by baking. Thus, the fabrication of the Example 2 enameled insulated wire coated with a 30-μm thick insulation coating was completed. This final process step was performed by a conventional method.

Preparation of Example 3

A 1.0-mm diameter copper wire was used as a metal conductor. First, the copper wire was surface cleaned and annealed simultaneously in a manner similar to that used in Example 2. Next, a processing solution containing an organic metal compound was coated around the copper wire by dipping the copper wire in the processing solution. Then, the thus coated processing solution was dried and baked to form an intermediate layer. The processing solution used was tin 2-ethylhexanoate dissolved in a 1:1 mixed solvent of acetone and toluene (the Sn concentration was 0.5 mass %). The baking was performed by heating at 200° C. in air atmosphere for 30 minutes under irradiation of UV light. The UV light irradiation was performed using a 5-Hz ArF laser (wavelength of 193 nm, and output power of 50 mJ/cm$^2$). The laser beam was split with a beam splitter. The sample was irradiated from opposite sides by adjusting the reflected directions of the split beams with mirrors.

Finally, an insulation varnish made of a polyesterimide-based resin composition was applied around the intermediate layer followed by baking. Thus, the fabrication of the Example 3 enameled insulated wire coated with a 30-μm thick insulation coating was completed. This final process step was performed by a conventional method.

Preparation of Example 4

A 1.0-mm diameter copper wire was used as a metal conductor. First, the copper wire was surface cleaned and annealed simultaneously in a manner similar to that used in Example 2. Next, a processing solution containing an organic metal compound was coated around the copper wire by dipping the copper wire in the processing solution. Then, the thus coated processing solution was dried and baked to form an intermediate layer. The processing solution used was zinc acetylacetonate dissolved in a methanol solvent (the Zn concentration was 0.5 mass %). The baking was performed by heating at 200° C. in air atmosphere for 30 minutes under irradiation of UV light. The UV light irradiation was performed using a low pressure mercury lamp (center wavelength of 254 nm, lamp intensity of 40 mW/cm, and distance between lamp and sample of 10 cm) mounted in the heat treatment furnace used.

Finally, an insulation varnish made of a polyesterimide-based resin composition was applied around the intermediate layer followed by baking. Thus, the fabrication of the Example 4 enameled insulated wire coated with a 30-μm thick insulation coating was completed. This final process step was performed by a conventional method.

Preparation of Comparative Example 1

A 1.0-mm diameter copper wire was used as a metal conductor. First, the copper wire was surface cleaned and annealed simultaneously in a manner similar to that used in Example 2. Next, an insulation varnish made of a polyesterimide-based resin composition was applied around the copper wire followed by baking. Thus, the fabrication of the Comparative example 1 enameled insulated wire coated with a 30-μm thick insulation coating was completed. As is apparent, Comparative example 1 was the same as Example 2 except that it was not coated with any intermediate layer.

Preparation of Comparative Example 2

A 1.0-mm diameter copper wire was used as a metal conductor. First, the copper wire was surface cleaned and annealed simultaneously in a manner similar to that used in Example 2. Then, the surface of the copper wire was silane coupling agent treated using a mercaptosilane compound. Finally, an insulation varnish made of a polyesterimide-based resin composition was applied around the silane coupling agent treated copper wire followed by baking. Thus, the fabrication of the Comparative example 2 enameled insulated wire coated with a 30-μm thick insulation coating was completed. Comparative example 2 was the same as Example 2 except that it was coated with a conventional organic intermediate layer instead of the Example 2 intermediate layer.

Preparation of Comparative Example 3

A 1.0-mm diameter copper wire was used as a metal conductor. First, the copper wire was surface cleaned and annealed simultaneously in a manner similar to that used in Example 2. Then, a sol-gel solution was coated around the copper wire by dipping the copper wire in the sol-gel solution. Then, the thus coated sol-gel solution was dried and baked to form an intermediate layer. The sol-gel solution was prepared as follows: Zinc isopropoxide was added to isopropanol followed by addition of diethanolamine (the Zn concentration was 0.5 mol/L). The resultant mixture was stirred at room temperature for 10 hours. The addition of diethanolamine was for the purpose of stabilization. And, the molar ratio of zinc isopropoxide to diethanolamine was 1:1. The baking was performed by heating at 200° C. in air atmosphere for 100 minutes under irradiation of UV light. The UV light irradiation was performed using a low pressure mercury lamp (center wavelength of 254 nm, lamp intensity of 40 mW/cm, and distance between lamp to sample of 10 cm) mounted in the heat treatment furnace used.

Finally, an insulation varnish made of a polyesterimide-based resin composition was applied around the intermediate layer followed by baking. Thus, the fabrication of the Comparative example 3 enameled insulated wire coated with a 30-μm thick insulation coating was completed. Thus, the intermediate layer of Comparative example 3 was not formed according to the present invention.

Preparation of Example 5

A 1.0-mm diameter copper wire was used as a metal conductor. First, the copper wire was surface cleaned in a manner similar to that used in Example 1. Next, a processing solution containing an organic metal compound was coated around the copper wire by dipping the copper wire in the processing solution. Then, the thus coated processing solution was dried and baked to form an intermediate layer. The processing solution used was zinc 2-ethylhexanoate dissolved in a 1:1 mixed solvent of acetone and toluene (the Zn concentration was 0.1 mass %). The baking was performed by heating at 300° C. in nitrogen atmosphere for 20 minutes. In Example 5, the process step of baking the intermediate layer also served to anneal the copper wire.

Finally, an insulation varnish made of a polyamideimide based resin composition was applied around the intermediate layer followed by baking. Thus, the fabrication of the Example 5 enameled insulated wire coated with a 30-μm thick insulation coating was completed. This final process step was performed by a conventional method.

Preparation of Example 6

A 1.0-mm diameter copper wire was used as a metal conductor. First, the copper wire was surface cleaned and annealed simultaneously in a manner similar to that used in Example 2. Next, a processing solution containing an organic metal compound was coated around the copper wire by dipping the copper wire in the processing solution. Then, the thus coated processing solution was dried and baked to form an intermediate layer. The processing solution used was zinc 2-ethylhexanoate dissolved in a 1:1 mixed solvent of acetone and toluene (the Zn concentration was 0.1 mass %). The baking was performed by heating at 150° C. in air atmosphere for 40 minutes under irradiation of UV light. The UV light irradiation was performed using a low pressure mercury lamp (center wavelength of 254 nm, lamp intensity of 40 mW/cm, and distance between lamp and sample of 10 cm) mounted in the heat treatment furnace used.

Finally, an insulation varnish made of a polyamideimide based resin composition was applied around the intermediate layer followed by baking. Thus, the fabrication of the Example 6 enameled insulated wire coated with a 30-μm thick insulation coating was completed. This final process step was performed by a conventional method.

Preparation of Comparative Example 4

A 1.0-mm diameter copper wire was used as a metal conductor. First, the copper wire was surface cleaned and annealed simultaneously in a manner similar to that used in Example 2. Next, an insulation varnish made of a polyamideimide based resin composition was applied around the copper wire followed by baking. Thus, the fabrication of the Comparative example 4 enameled insulated wire coated with a 30-μm thick insulation coating was completed. Comparative example 4 was the same as Example 5 except that it was not coated with any intermediate layer.

Preparation of Comparative Example 5

A 1.0-mm diameter copper wire was used as a metal conductor. First, the copper wire was surface cleaned and annealed simultaneously in a manner similar to that used in Example 2. Then, the surface of the copper wire was silane coupling agent treated using a mercaptosilane compound. Finally, an insulation varnish made of a polyamideimide based resin composition was applied around the silane coupling agent treated copper wire followed by baking. Thus, the fabrication of the Comparative example 5 enameled insulated wire coated with a 30-μm thick insulation coating was completed. Comparative example 5 was the same as Example 5 except that it was coated with a conventional organic intermediate layer instead of the Example 5 intermediate layer.

Preparation of Example 7

A 1.0-mm diameter copper wire was used as a metal conductor. First, the copper wire was surface cleaned and annealed simultaneously in a manner similar to that used in Example 2. Next, a processing solution containing an organic metal compound was coated around the copper wire by dipping the copper wire in the processing solution. Then, the thus coated processing solution was dried and baked to form an intermediate layer. The processing solution used was zinc 2-ethylhexanoate dissolved in a 1:1 mixed solvent of acetone and toluene (the Zn concentration was 0.01 mass %). The baking was performed by heating at 200° C. in air atmosphere for 30 minutes under irradiation of UV light. The UV light irradiation was performed using a low pressure mercury lamp (center wavelength of 254 nm, lamp intensity of 40 mW/cm, and distance between lamp and sample of 10 cm) mounted in the heat treatment furnace used.

Finally, an insulation varnish made of a polyimide-based resin composition was applied around the intermediate layer followed by baking. Thus, the fabrication of the Example 7 enameled insulated wire coated with a 30-μm thick insulation coating was completed. This final process step was performed by a conventional method.

Preparation of Comparative Example 6

A 1.0-mm diameter copper wire was used as a metal conductor. First, the copper wire was surface cleaned and annealed simultaneously in a manner similar to that used in Example 2. Next, an insulation varnish made of a polyimide-based resin composition was applied around the copper wire followed by baking. Thus, the fabrication of the Comparative example 6 enameled insulated wire coated with a 30-μm thick insulation coating was completed. Comparative example 6 was the same as Example 7 except that it was not coated with any intermediate layer.

Preparation of Example 8

A 1.0-mm diameter copper wire was used as a metal conductor. First, the copper wire was surface cleaned and annealed simultaneously in a manner similar to that used in Example 2. Next, a processing solution containing an organic metal compound was coated around the copper wire by dipping the copper wire in the processing solution. Then, the thus coated processing solution was dried and baked to form an intermediate layer. The processing solution used was zinc 2-ethylhexanoate dissolved in a 1:1 mixed solvent of acetone and toluene (the Zn concentration was 1.0 mass %). The baking was performed by heating at 200° C. in air atmosphere for 30 minutes under irradiation of UV light. The UV light irradiation was performed using a low pressure mercury lamp (center wavelength of 254 nm, lamp intensity of 40 mW/cm, and distance between lamp and sample of 10 cm) mounted in the heat treatment furnace used.

Finally, an insulation varnish made of a polyester-based resin composition was applied around the intermediate layer followed by baking. Thus, the fabrication of the Example 8 enameled insulated wire coated with a 30-μm thick insulation coating was completed. This final process step was performed by a conventional method.

Preparation of Comparative Example 7

A 1.0-mm diameter copper wire was used as a metal conductor. First, the copper wire was surface cleaned and annealed simultaneously in a manner similar to that used in Example 2. Next, an insulation varnish made of a polyester-based resin composition was applied around the copper wire followed by baking. Thus, the fabrication of the Comparative example 7 enameled insulated wire coated with a 30-μm thick insulation coating was completed. Comparative example 7 was the same as Example 8 except that it was not coated with any intermediate layer.

Preparation of Example 9

A 1.0-mm diameter copper wire was used as a metal conductor. First, the copper wire was surface cleaned and annealed simultaneously in a manner similar to that used in Example 2. Next, a processing solution containing an organic metal compound was coated around the copper wire by dipping the copper wire in the processing solution. Then, the thus coated processing solution was dried and baked to form an intermediate layer. The processing solution used was tin 2-ethylhexanoate dissolved in a 1:1 mixed solvent of acetone and toluene (the Sn concentration was 0.1 mass %). The baking was performed by heating at 200° C. in air atmosphere for 30 minutes under irradiation of UV light. The UV light irradiation was performed using a low pressure mercury lamp (center wavelength of 254 nm, lamp intensity of 40 mW/cm, and distance between lamp and sample of 10 cm) mounted in the heat treatment furnace used.

Finally, an insulation varnish made of a polyurethane-based resin composition was applied around the intermediate layer followed by baking. Thus, the fabrication of the Example 9 enameled insulated wire coated with a 30-μm thick insulation coating was completed. This final process step was performed by a conventional method.

Preparation of Comparative Example 8

A 1.0-mm diameter copper wire was used as a metal conductor. First, the copper wire was surface cleaned and annealed simultaneously in a manner similar to that used in Example 2. Next, an insulation varnish made of a polyurethane-based resin composition was applied around the copper wire followed by baking. Thus, the fabrication of the Comparative example 8 enameled insulated wire coated with a 30-μm thick insulation coating was completed. Comparative example 8 was the same as Example 9 except that it was not coated with any intermediate layer.

The enameled insulated wires of Examples 1 to 9 and Comparative examples 1 to 8 were tested for the adhesion by the above-described method. The result is shown in Table 1. Table 1 also shows the average thicknesses of the intermediate layers. The average thickness was determined by the following method: Each enameled insulated wire was transversely cut at three positions, and each cut surface was polished. Next, the thickness of the intermediate layer at each position was measured on the SEM image of the cut and polished surface. Then, the average thickness of the intermediate layer of the wire was determined by averaging the thus measured thicknesses at the three positions.

TABLE 1

Structure of enameled insulated wire and result of adhesion test.

| | Insulating Coating | Intermediate Layer | *1 | *2 | *3 |
|---|---|---|---|---|---|
| Example 1 | Polyesterimide based resin composition | Amorphous matrix + Metal oxide particles | 300 | 95 | 92 |
| Example 2 | | Metal oxide particles | 150 | 94 | 93 |
| Example 3 | | | 500 | 92 | 91 |
| Example 4 | | | 20 | 90 | 89 |
| Comparative example 1 | | None | 0 | 81 | 82 |
| Comparative example 2 | | Silane coupling agent treatment | 10 | 93 | 44 |
| Comparative example 3 | | Metal oxide particles | 50 | 75 | 62 |
| Example 5 | Polyamideimide based resin composition | Amorphous matrix + Metal oxide particles | 400 | 63 | 61 |
| Example 6 | | Metal oxide particles | 2000 | 60 | 60 |
| Comparative example 4 | | None | 0 | 49 | 49 |
| Comparative example 5 | | Silane coupling agent treatment | 10 | 62 | 31 |
| Example 7 | Polyimide based resin composition | Metal oxide particles | 150 | 101 | 98 |
| Comparative example 6 | | None | 0 | 87 | 84 |

TABLE 1-continued

Structure of enameled insulated wire and result of adhesion test.

| | Insulating Coating | Intermediate Layer | *1 | *2 | *3 |
|---|---|---|---|---|---|
| Example 8 | Polyester based resin | Metal oxide particles | 150 | 110 | 109 |
| Comparative example 7 | composition | None | 0 | 101 | 99 |
| Example 9 | Polyurethane based resin | Metal oxide particles | 500 | 112 | 111 |
| Comparative example 8 | composition | None | 0 | 100 | 96 |

*1: Average thickness of intermediate layer (nm);
*2: Initial adhesion (Number of rotations); and
*3: Adhesion after test-heating (at 160° C. for 6 h) (Number of rotations).

As can be seen from Table 1, each of the enameled insulated wires of Examples 1 to 9 exhibited an improved adhesion both before and after the test-heating compared to its counterpart Comparative examples coated with the same insulation coating. Specifically, in the initial adhesion test, the number of rotations for each Example was 9 to 14 more than that of its counterpart Comparative example which was coated with the same insulation coating but was not coated with any intermediate layer. In this "peeling-by-rotation test", the torque exerted on a wire under test increases rapidly with increasing the number of rotations. Therefore, the above increases in the number of rotations suggest more significant improvement than it might appear.

The enameled insulated wires treated with silane coupling agent (Comparative examples 2 and 5) exhibited a good initial adhesion, but a very poor adhesion after the test-heating. By contrast, the invented enameled insulated wires exhibited a good initial adhesion comparable to those of the silane coupling agent treated enameled insulated wires, and also exhibited a good adhesion even after the test-heating. It is thus demonstrated that the invented enameled insulated wires have high long term thermal resistance.

As described before, it can be predicted that an enameled insulated wire coated with an intermediate layer composed of an organic amorphous matrix having dispersed therein metal oxide particles is more easy to bend or stretch (i.e., has better flexibility and durability) because such an intermediate layer can absorb such bending or flexing stresses exerted on the wire. Turning again to Table 1 with the above prediction in mind, each of Examples having the intermediate layer composed of an organic amorphous matrix having dispersed therein metal oxide particles, as is predicted, exhibited a slightly higher initial adhesion than its counterpart Examples which were coated with the same insulation coating but whose intermediate layer was composed of metal oxide particles alone.

The enameled insulated wire of Comparative example 3 exhibited a poorer adhesion both before and after the test-heating than Examples 1 to 4. A probable reason for this is as follows: When an intermediate layer was formed by applying a sol-gel solution followed by baking at a temperature of about 200° C., such a temperature level did not provide sufficient energy for formation of crystalline particles (i.e., nucleation and crystal growth), and therefore few or no metal oxide particles were formed. As a result, less or no surface microroughness was created, and therefore no mechanical bonding effect (anchor effect) was provided. Also, no chemical bonding effect (chemical interaction between a polar functional group in an insulation coating and metal oxide particles) was provided. Still worse, organic residues in the intermediate layer caused the adverse effect of degrading adhesion after the test-heating. In view of the above results, the invented method for manufacturing an enameled insulated wire is an excellent method with a wide process temperature margin.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. An enameled insulated wire, comprising:

a metal conductor;

an intermediate layer formed directly on and around the metal conductor, the intermediate layer containing metal oxide particles, the metal oxide particles including at least one oxide selected from a group consisting of zinc oxides, tin oxides, compound oxides of zinc and the metal constituent of the metal conductor, and compound oxides of tin and the metal constituent of the metal conductor, a diameter of the metal oxide particles being predominantly from 1 to 50 nm, and the intermediate layer having a surface microroughness due to the metal oxide particles; and an insulation coating around the intermediate layer.

2. The enameled insulated wire according to claim 1, wherein the intermediate layer is an organic amorphous matrix having dispersed therein the metal oxide particles.

3. The enameled insulated wire according to claim 1, wherein an average thickness of the intermediate layer is from 20 to 2000 nm.

4. The enameled insulated wire according to claim 1, wherein the insulation coating is made of a resin composition including, as a major constituent, a material selected from a group consisting of polyesterimide, polyamideimide, polyimide, polyester and polyurethane.

5. The enameled insulated wire according to claim 1, wherein the metal conductor is made of a metal selected from a group consisting of copper, copper alloys, aluminum and aluminum alloys.

6. The enameled insulated wire according to claim 1, wherein the surface microroughness is from several tens of nanometers to several hundreds of nanometers.

7. An enameled insulated wire, comprising:

a metal conductor, an intermediate layer formed directly on and around the metal conductor, the intermediate layer being formed by baking a processing solution applied around the metal conductor, the processing solution including an organic metal compound, the organic metal compound including an organic caboxylic acid metal complex and/or a β-diketone metal complex, the organic metal compound including, as a metal constituent, zinc and/or tin, the intermediate layer containing metal oxide particles, the metal oxide particles including at least one oxide selected from a group consisting of zinc oxides, tin oxides, compound oxides of zinc and the metal constituent of the metal conductor, and compound oxides of tin and the metal constituent of the metal conductor, a diameter of the metal oxide particles being predominantly from 1 to 50 nm, the intermediate layer having a surface microroughness due to the metal oxide particles; and an insulation coating around the intermediate layer.

8. The enameled insulated wire according to claim 7, wherein the surface microroughness is from several tens of nanometers to several hundreds of nanometers.

9. An enameled insulated wire, comprising:

a metal conductor;

an intermediate layer formed directly on and around the metal conductor, the intermediate layer being formed by baking a processing solution applied around the metal conductor, the processing solution including an organic metal compound, the organic metal compound including an organic caboxylic acid metal complex and/or a β-diketone metal complex, the organic metal compound including, as a metal constituent, zinc and/or tin, the intermediate layer containing metal oxide particles, the metal oxide particles including at least one oxide selected from a group consisting of zinc oxides, tin oxides, compound oxides of zinc and the metal constituent of the metal conductor, and compound oxides of tin and the metal constituent of the metal conductor, a diameter of the metal oxide particles being predominantly from 1 to 50 nm, the intermediate layer having a surface microroughness due to the oxide of the metal constituent of the organic metal compound, and an insulation coating around the intermediate layer.

10. The enameled insulated wire according to claim 9, wherein the surface microroughness is from several tens of nanometers to several hundreds of nanometers.

* * * * *